United States Patent [19]

Finkin

[11] 4,170,355

[45] Oct. 9, 1979

[54] EDUCATIONAL PUZZLES

[76] Inventor: Stephen E. Finkin, 39 W. 83rd St., New York, N.Y. 10024

[21] Appl. No.: 840,112

[22] Filed: Oct. 6, 1977

[51] Int. Cl.[2] ..... A63F 9/08; G09B 1/32

[52] U.S. Cl. ..... 273/155; 35/9 R

[58] Field of Search ..... 35/28, 8 R, 9 R; 46/1 L; 273/153 R, 155

[56] References Cited

U.S. PATENT DOCUMENTS

| | | | |
|---|---|---|---|
| 502,896 | 8/1893 | Vine | 46/1 L |
| 566,854 | 9/1896 | Frank | 273/153 R |
| 847,545 | 3/1907 | Braine | 273/153 R |
| 1,547,967 | 7/1925 | Shilhan | 273/153 R X |
| 2,327,875 | 8/1943 | Edborg | 273/155 |
| 2,491,164 | 12/1949 | Dircky | 273/155 X |

FOREIGN PATENT DOCUMENTS

| | | | |
|---|---|---|---|
| 20413 | of 1907 | United Kingdom | 273/155 |

*Primary Examiner*—William H. Grieb

*Attorney, Agent, or Firm*—Handal & Sims

[57] ABSTRACT

An educational puzzle particularly adapted to teach children relationships between pairs of items of information is disclosed. The puzzle comprises a central planar portion which functions as the main body of the puzzle together with a plurality of arm members which extend from the main body portion. Each of the pairs of items forms a message pair and the parts of the message pairs, that is to say the parts of the items that make up each message pair are disposed in demarcated areas on the arms and are arranged in such a manner that the arms may be folded to solve the puzzle for the members of a message pair.

10 Claims, 10 Drawing Figures

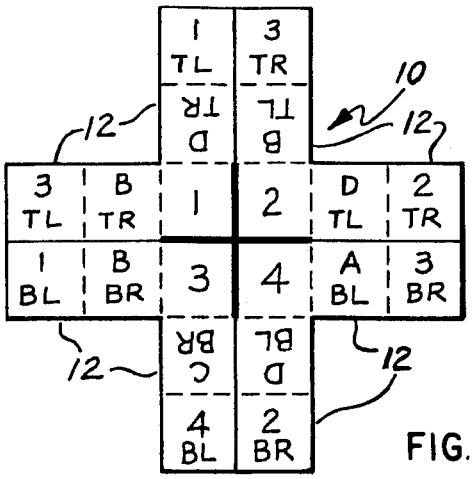
FIG. 1
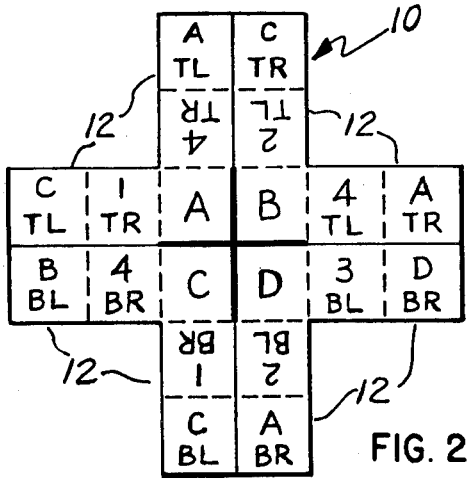
FIG. 2
FIG. 3
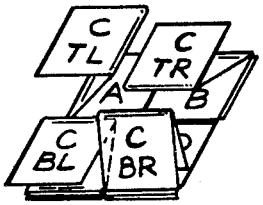
FIG. 4
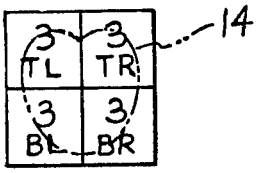
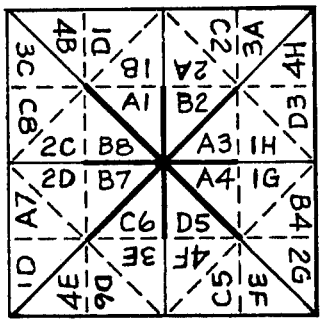
FIG. 5
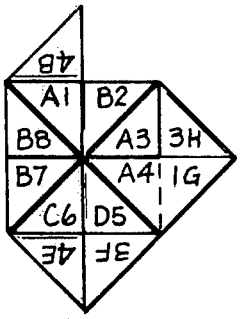
FIG. 7
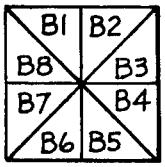
FIG. 9
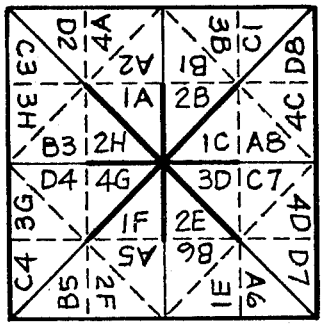
FIG. 6
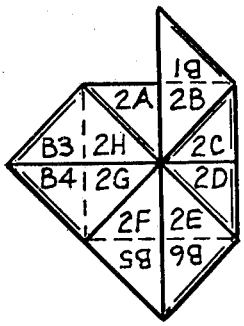
FIG. 8
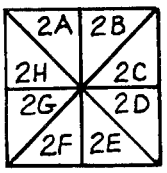
FIG. 10

EDUCATIONAL PUZZLES

BACKGROUND OF THE INVENTION

In recent years, educators have sought to increase the effectiveness of the education of young children by introducing a recreational aspect to learning. Recent innovations have gone well beyond the relatively simple concepts of generations ago, which included alphabet building blocks and the like.

Modern innovations in this field include such sophisticated and diverse devices as programmed courses on magnetic tape cassettes, narrow theme repeated-message television shows and learning cards.

The present invention relates to puzzles which are particularly adopted to perform an educational function. Unlike conventional puzzles, the inventive puzzles are solved by folding parts of the flat planar element of which the puzzle is made upon one another to form an educational message. Moreover, the puzzles are so made that two messages are displayed on opposite sides of the puzzle at the same time. These two messages may be associated with each other to form a learning pair, which may be, for example, a question and an answer. The construction of the puzzle is such that the puzzle cannot be solved for two messages without displaying the two messages of a learning pair. In this manner, a child using the puzzle learns the relationship between messages in a learning pair. In accordance with the preferred embodiment, a single puzzle may carry four learning pairs or a total of eight messages.

Inasmuch as a puzzle constructed in accordance with the invention is a flat planar element, which may be made of paper or any suitable material, with printing on both sides, it may be sold in kit form as a single sheet of paper with instructions on how to construct it. This provides an added dimension to the puzzle because if a child has made something himself, he is more likely to remain interested in it.

SUMMARY OF THE INVENTION

In accordance with the present invention, the puzzle comprises a central planar member. A plurality of planar arm members are each divided into demarcated areas and extend from the central planar member. Each of the arm members are adapted to be folded at the boundaries between the demarcated areas. A first group of items of information are disposed on the arm members, one in each of the demarcated areas on the obverse and reverse of the arm members. The arrangement of the items in the first group is such that the arm members may be folded to form one of a plurality of message pairs, one of the messages of the message pair appearing on the obverse of the puzzle and composed of some of said items and the other message of the pair appearing on the reverse and composed of others of the items. The arrangement of the items in the first group is further such that when one message of a message pair appears on one side of the puzzle, only the other message of the message pair can be formed on the other side.

BRIEF DESCRIPTION OF THE DRAWINGS

FIG. 1 is a schematic top plan view of the obverse of a folding puzzle constructed in accordance with the present invention;

FIG. 2 is a schematic view of the reverse of the puzzle illustrated in FIG. 1.

FIG. 3 is a perspective view of the puzzle illustrated in FIG. 1 after it has been solved;

FIG. 4 is a schematic view of the reverse of the puzzle illustrated in FIG. 3 after it has been solved;

FIG. 5 is a schematic top plan view of the obverse of an alternative embodiment of the present invention;

FIG. 6 is a schematic view of the reverse of the puzzle illustrated in FIG. 5;

FIG. 7 is a schematic view of the puzzle illustrated in FIG. 5 while it is being solved;

FIG. 8 is a schematic view of the reverse of the puzzle when it is in the stage of solution illustrated in FIG. 7;

FIG. 9 is a schematic view of the puzzle illustrated in FIG. 5 after it has been solved;

FIG. 10 is a schematic view of the reverse of the puzzle after it has been solved in the matter illustrated in FIG. 9.

DETAILED DESCRIPTION OF THE PREFERRED EMBODIMENTS

Referring to FIGS. 1–4, a puzzle constructed in accordance with the present invention is illustrated. Puzzle 10 is made of a flat planar element having the general outlines illustrated in solid lines in FIG. 1. It includes a central planar portion and a plurality of arms 12 that extend from the central portion. The puzzle is solved by folding in the manner generally indicated in FIG. 3 along the dashed lines shown in FIG. 1.

The obverse of the puzzle is printed with information according to the plan indicated schematically of FIG. 1. The obverse and reverse of the puzzle are divided into a number of demarcated areas or facets which are demarcated by solid lines, broken lines and bold lines. Solid lines indicate the edges of the planar sheet from which the puzzle is made. A broken line indicates where the puzzle may be folded in order to get the solution. The bold lines indicate boundaries between printed matter which are neither folding lines nor edges. Thus, if one wished to make one of the inventive puzzles, one would print information on a planar sheet in accordance with the plan illustrated in FIGS. 1 and 2. One would then take a knife and cut along the solid lines.

Referring in particular to FIGS. 1 and 2, the inventive puzzle 10 is printed on both its obverse (FIG. 1) and its reverse (FIG. 2). Inside the facets indicated by dashed and bold lines, various items of information consisting of eight pictures or messages are printed. For convenience sake we will refer to these messages as subjects 1, 2, 3 and 4 and corresponding subjects A, B, C and D. In accordance with the plan illustrated in FIGS. 1 and 2, subject 1 is associated with corresponding subject A, subject 2 is associated with corresponding subject B, subject 3 is associated with corresponding subject C, and subject 4 is associated with corresponding subject D. Each of these subjects are illustrated in complete form, though reduced in size, in the facet labeled with its alpha-numeric designation. The positions of facets 1–4 and A–D on the main body portion don't affect the solution of the puzzle. However, it is contemplated that facets 1 through 4 will appear on one side of the puzzle and facets A through D will appear on the other side.

To give an example of the information which might be carried in these facets, we might put a picture of an apple in facet 1, a picture of an orange in facet 2, a picture of a peach in facet 3, and a picture of a strawberry in facet 4. On the opposite side of the puzzle one would put a cross-section of an apple, that is a picture of what an apple looks like when it has been split by a plane passing through its axis of rotation, in facet A, the cross-section of an orange in facet B, the cross-section of a peach in facet 3 and a cross-section of a strawberry in facet 4. The object of the puzzle would be to teach the child the association between the element pairs comprising pictures of fruit and pictures of their cross-sections.

The remaining facets of the puzzle are each printed with one quarter or quadrant of an enlarged picture of the subjects and corresponding subjects. When the puzzle is solved, the four quadrants of both a subject and its corresponding subject come together on opposite sides of the solved puzzle to illustrate an association which the child is to learn. Naturally, these pictures of the subjects and corresponding subjects are twice the size, or have four times the area of the small illustrations in the central portion of the puzzle that are labeled 1 through 4 and A through D.

The information carried on each of the facets is labeled with a three-character code. The upper number of letter indicates the particular subject or corresponding subject, respectively. The bottom two letters indicate the quadrant of the subject, with TR meaning the top-right quadrant, TL meaning the top-left quadrant, BL meaning the bottom-left quadrant and BR meaning the bottom-right quadrant. When the puzzle is solved, the four quadrants come together to form a picture, such as the peach 14 illustrated in FIG. 4. The orientation of the information printed on the facet is important and it should follow the orientation of the alpha-numeric designations illustrated in FIGS. 1 through 4. Naturally, the relative positions between information printed on the obverse and reverse of the puzzle is important. The plans illustrated in FIGS. 1 and 2 should be used in such a manner that the top right quadrant of subject 2 (facet 2 TR) is printed on the other side of the top-left quadrant (facet C TL) of corresponding subject C. With this particular alignment, facet 3 BR will appear opposite facet B BL, facet A TR will appear opposite facet 3 TL, and facet A BR will appear opposite facet 4 BL.

When it is desired to solve the inventive puzzle, the parts of the puzzle carrying the various quadrants of information are folded one upon the other to put together two complete messages. The layout of quadrants on the puzzle is such that it is impossible to obtain two complete messages or pictures unless those pictures belong to a subject and its corresponding subject. A typical solution is illustrated in FIGS. 3 and 4. To make this solution, the puzzle is placed as illustrated in FIG. 2. Facet A BR is brought into contact with facet 2 BL by folding along the line between these two facets. Facet 4 BL is then put into contact with facet D by being folded against facet D. Facet 1 BR is then brought into contact with facet C by being folded along the line which divides those two facets. Facet 2 BR is then brought into contact with facet D BL by folding along the line between those two facets. Facet 1 TR is then folded against facet A and facet 2 TR is folded against facet D TL. Facet 2 TL is folded against facet B and facet 1 TL is folded against facet D TR. The puzzle is then turned over and facet A BL is folded against facet 4 and facet B BL is folded against facet 4 BR. Facet B TL is folded against facet 2 and facet A TL is folded against facet 4 TR. Facet B TR is folded against facet 1 and facet A TR is folded against facet 4 TL. Finally facet 1 BL is folded against facet B BR and facet D BR is folded against facet 3. Subject 3 and corresponding subject C are then displayed on opposite sides of the puzzle. The display of subject 3 is illustrated in FIG. 4 and the way that the four quadrants of corresponding subject C go to make up a complete picture of corresponding subject C is illustrated in FIG. 3.

Referring to FIGS. 5–10, an alternative embodiment of a puzzle constructed in accordance with the present invention is illustrated. This puzzle also has four subjects 1 through 4, and four corresponding subjects A through D.

In this embodiment, the elements of the subjects and corresponding subjects are a series of eight triangular facets which, when arranged in clockwise order, as in FIGS. 9 and 10, come together to produce a complete picture of the subject or corresponding subject. Each of these facets is designated by a two-character designation. For the subjects, the first character identifies the subject and the second character, consisting of one of the letters from the series comprising the letters A through H signifies the position of the facet relative to the other facets. When the puzzle is solved, as illustrated in FIG. 10, the top-left hand facet is always labeled facet A, and succeeding facets in the clockwise direction are successively labeled with the successive letters of the alphabet. In the case of corresponding subjects, the first character designates the corresponding subject and the second character, consisting of the numbers 1 through 8 designates the part of the picture of the corresponding subject which the facet is a part of. As illustrated in FIG. 9, the facet with the second character designation 1 always take the top-left hand position and is followed by successive facets labeled with the same first character designation and successively with the numbers 2 through 8 in the clockwise direction.

In FIGS. 5–10, the schematic representation of solid, bold and broken lines have the same meaning as those in FIGS. 1–4. Likewise, the orientation of the alphanumeric designations of the facets are identical to the orientation of those parts of the pictures of subjects and corresponding subjects which they represent. In this puzzle, subject one corresponds to corresponding subject A, subject 2 corresponds to corresponding subject B, subject 3 corresponds to corresponding subject C and subject 4 corresponds to corresponding subject D. In order for two halves of the puzzle to be solved at the same time, it is necessary that those halves represent a subject pair comprising a subject and its corresponding subject.

The eight elements of each of the eight pictures which are included among the subjects and corresponding subjects carried by the puzzle illustrated in FIGS. 5–10, are printed on the puzzle in accordance with the pattern illustrated in FIGS. 5 and 6 and with the orientations illustrated there. The orientation of the obverse, illustrated in FIG. 5, with respect to the reverse, illustrated in FIG. 6, is such that the opposite side of facet D8 is printed with facet 3C, the opposite side of facet 2F is printed with facet C5, the opposite side of facet C3 is printed with 4H and the opposite side of facet 3B is printed with D1. Cuts occur between facets B5 and C4, B6 and A5, A6 and D7, A8 and C7, D8 and C1, B1 and A2, D2 and C3, and B3 and D4.

When it is desired to solve the puzzle in FIGS. 5 and 6, the puzzle is put in the position illustrated in FIG. 5. Facet D1 is folded over facet 1B and facet C1 is folded over facet 3B as shown in FIG. 7. The puzzle is then turned over and facet 4A is folded over facet A2, and facet C2 is folded over facet 3A. The puzzle is turned over and facet 4H is folded over D3. Facet C3 is then folded over facet 1H. The puzzle is turned over and facet 3G is folded over facet D4. Facet A5 is folded over facet 1F and facet C5 is folded over facet 4F. The puzzle is turned over and facet D6 is folded over 3E and A6 is folded over 1E. The puzzle is turned over and facet 4D is then folded over C7 and A7 is folded over 1D. Facet 4C is folded over A8 and C8 is folded over 3C. The puzzle is then in the position illustrated in FIGS. 7 and 8 with the side illustrated in FIG. 8 exposed to view.

The solution to the puzzle is then finished by folding facets 4B over A1, 3H over A3, 1G over A4, 3F over D5, and 4E over C6.

While an illustrative embodiment of the invention has been shown, it is of course understood that various modifications will be obvious to those of ordinary skill in the art. Such modifications are within the spirit and scope of the invention which is limited and defined only by the appended claims.

I claim:

1. A puzzle, comprising:

(a) a central planar member;

(b) a plurality of planar arm members extending from said central planar member, the obverse and reverse of each of said arm members being divided into demarcated areas and adapted to be folded at the boundaries between said demarcated areas; and (c) a first group of items of information disposed on said arm members, one in each of said demarcated areas on the obverse and reverse of said arm members, the arrangement of said items in said first group being such that the arm members may be folded to form one of a plurality of message pairs, one of said messages of said pair appearing on the obverse of the folded puzzle and composed of some of said items and the other message of said pair appearing simultaneously on the reverse of the folded puzzle and composed of others of said items and said items in said first group being positioned, configured and dimensioned so that when one message of a message pair appears on one side of the folded puzzle, only the other message of the message pair can be formed on the other side.

2. A puzzle as in claim 1, further comprising:

(d) a second group of items of information disposed on the obverse of said central planar member; and (e) a third group of items of information disposed on the reverse of said central planar member.

3. A puzzle as in claim 2, wherein said groups of items of information are printed and said central planar member and said arms are made of paper.

4. A puzzle as in claim 2, wherein said first, second and third groups of items of information all contribute to form parts of at least one of said messages.

5. A puzzle as in claim 4 wherein there are eight arm members and four message pairs.

6. A puzzle as in claim 5, wherein the demarcated areas on said arm members and said central planar member are all triangular in shape.

7. A puzzle as in claim 1, wherein there are eight arm members, each of said arm members carrying four items of information and wherein the number of message pairs is four.

8. A puzzle as in claim 7, wherein the central planar member is square and each arm member may be divided into two square demarcated areas on each side and two arm members are attached to each of the four sides of the square central planar member, whereby two arm members are adjacent each corner of the square central planar member and wherein one of said adjacent arm members carries an item associated with one message of a message pair and the other arm member carries an item associated with the other message of said message pair.

9. A puzzle as in claim 1, wherein said central planar member together with said arm members gives the puzzle an overall shape which is planar and concave when the puzzle is not folded.

10. A puzzle as in claim 1, wherein said items of information are asymmetrical when the puzzle is not folded.

* * * * *